US005105564A

United States Patent [19]

Motoda

[11] Patent Number: 5,105,564

[45] Date of Patent: Apr. 21, 1992

[54] INSOLE PART FOR USE IN MANUFACTURING SHOES

[75] Inventor: Shingo Motoda, Tokyo, Japan

[73] Assignee: Kabushiki Kaisha Tobi, Tokyo, Japan

[21] Appl. No.: 653,852

[22] Filed: Feb. 6, 1991

Related U.S. Application Data

[60] Continuation of Ser. No. 464,098, Jan. 12, 1990, abandoned, which is a division of Ser. No. 256,789, Oct. 12, 1988, Pat. No. 4,918,776.

[30] Foreign Application Priority Data

Jul. 19, 1988 [JP] Japan ..... 63-179693

[51] Int. Cl.[5] ..... A43B 13/38; A43B 13/28

[52] U.S. Cl. ..... 36/43; 36/12

[58] Field of Search ..... 36/12, 19.5, 44, 43

[56] References Cited

U.S. PATENT DOCUMENTS

| | | | |
|---|---|---|---|
| 307,117 | 10/1884 | Johnson | 36/44 |
| 355,428 | 1/1887 | Whittlesey | 36/44 |
| 379,765 | 3/1888 | Cushman | 36/44 |
| 1,342,967 | 6/1920 | McMaster | 36/44 |
| 1,697,589 | 1/1929 | Cort | 36/44 X |
| 1,947,031 | 2/1934 | Bain | 36/43 X |
| 2,048,048 | 7/1936 | Ayers | 36/44 X |
| 2,115,810 | 5/1938 | Gorman | 36/19.5 |
| 2,138,109 | 11/1938 | Lindblad | 12/142 F |
| 2,144,330 | 1/1939 | Farrington | 12/142 F |
| 2,153,832 | 4/1939 | Gutwein | 36/44 |
| 2,182,042 | 12/1939 | Timson | 12/142 F |
| 2,809,450 | 10/1957 | Stritter | 36/44 |
| 3,474,478 | 10/1969 | Batchelder | 12/142 R |
| 4,597,125 | 7/1986 | Jones | 12/142 F |

*Primary Examiner*—Paul T. Sewell
*Assistant Examiner*—Ted Kavanaugh
*Attorney, Agent, or Firm*—Armstrong, Nikaido, Marmelstein, Kubovcik & Murray

[57] ABSTRACT

A method of making shoes of the type having a soft sole and an insole part used in the method. The insole part is produced by cementing a thin and soft insole sheet on a hard insole base so as to be easily peeled apart and separated. The method includes using the insole part in lieu of a conventional insole, performing a conventional lasting manufacturing method, separating the insole base from the insole sheet and leaving only the insole sheet. A highly efficient manufacturing method is thus provided by using a lasting machine.

5 Claims, 5 Drawing Sheets

INSOLE PART FOR USE IN MANUFACTURING SHOES

This application is a continuation of application Ser. No. 464,098 filed Jan. 12, 1990, abandoned which in turn is a divisional of application Ser. No. 256,789, filed Oct. 12, 1988, now U.S. Pat. No. 4,918,776.

FIELD OF THE INVENTION

This invention relates to a method of manufacturing shoes, and particularly to so called light and soft shoes having bottoms that are thin and flexible, and to an insole part to be used in the method of manufacturing the shoes.

DISCUSSION OF THE TECHNICAL PROBLEM

As a conventional method of manufacturing light shoes, a lasting type and a moccasin type are employed.

The lasting type manufacturing method, as shown in FIG. 6, comprises mounting an insole 2 (in FIG. 6A) on a bottom of a last 1 in the first place, tightly covering an upper 3 on the last 1, lasting the end portions of the upper 3 by superposing and cementing the end portions on a peripheral end portion of the insole 2 (FIG. 6B), superposing a filler 4 on the insole 2, superposing an outsole 5 on the filler 4 and the end portions of the upper 3 and cementing them (FIG. 6C), and pulling the last 1 out whereby the shoe (FIG. 6D) is completed.

The moccasin type manufacturing method, as shown in FIG. 7, comprises arranging a bottom part 7 and an apron 8 to cover a last 6, sewing the bottom part 7 and the apron 8 on the upper part of the last 6 (FIG. 7A), and pulling the last 6 out whereby the shoe is completed (FIG. 7B).

The foregoing lasting type manufacturing method offers certain advantages such as an execution of the method by using machine and a highly efficient production. However, in a process of lasting the upper 3 and cementing it on the insole 2, an end portion of the upper 3 is pulled out with a strong force in order to superpose the upper 3 on the insole 2 and to cement them by uniformly dispersing creases generated on the end portion. The insole 2 is required to have a sufficient thickness with a high rigidity and strength, and actually, leather, plywood and the like whose thickness is approximately 1.5-3 mm is employed, and as a result, the completed shoe has a thick and hard bottom.

On the other hand, in the moccasin type manufacturing method, the hard insole as described in the foregoing is not required so that shoes having a soft bottom part may be manufactured. However, when the bottom part 7 and the apron 8 are sewn at 9, the creases generated at the sewn portion must be equalized so that this sewing operation cannot be mechanized. The sewing operation must be performed by manually skilled workers which lowers productivity and increases the cost of manufacture.

Under the circumstances, this invention has been conceived with a view to which provides novel manufacturing method providing a high production efficiency equal to that of the lasting type manufacturing method and producing the shoes having a soft bottom similar to that produced by the moccasin type manufacturing method.

SUMMARY OF THE INVENTION

The present invention relates to a method of manufacturing shoes characterized in that an insole part is formed by cementing an insole sheet of soft and thin type on a thick insole base having a rigidity and strength capable of withstanding the lasting so that the insole sheet may be easily peeled apart from the insole base. The insole part is temporarily fixed to a bottom of the last with the insole sheet directed to the outside. An upper is caused to cover the last to be in contact and last the end portion of the upper, superposed on the peripheral end portion of the insole part to be cemented to the upper. The temporary fixing of the insole part is released, the last is pulled out, and the insole base is removed by peeling apart from the insole sheet.

An outsole part is usually cemented to the insole sheet opposite from the insole base and during cementing of the outsole, the filler may be interposed by superposing a filler on the insole part.

Also, instead of removing the whole insole base, only a part may be removed by peeling apart from the insole sheet and the rest of the insole base left intact.

Another invention of this application resides in the insole part and the insole sheet to be used in the insole part may be composed of not only the portion expanding over the entire surface of the insole base but also the portions to be superposed on the end portions of the upper. Furthermore, the insole sheet may be made of leather, and the grain may be used by cementing the leather with the grain directed to the insole base. Furthermore, the insole base may be divided with only a part of the insole base removed by peeling apart from the insole sheet.

According to this manufacturing method, since the insole part has a thick insole base so that there is no trouble in the lasting operation of the upper, the operation including the cementing of the outsole can be carried out in a manner entirely similar to the conventional lasting type manufacturing method. Although the insole base and the insole sheet are cemented, they may be easily peeled apart so that after the outsole is cemented and the last is removed, the insole base may be removed by peeling apart, and thus, the completed shoes has only the thin insole sheet on the surface of the insole, and thus, the bottom becomes thin and soft. Of course, when the insole base is only partially removed, only a portion of the bottom becomes soft.

BRIEF DESCRIPTION OF THE DRAWINGS

Other features and advantages of the method of manufacturing shoes and the insole part in accordance with the present inventions will become apparent from the following description given by way of non-limiting examples with reference to the accompanying drawings in which.

Figure 1A:
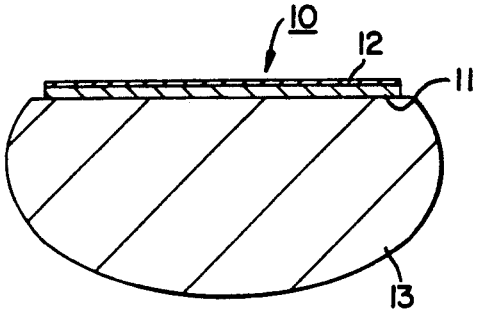
FIGS. 1A-1E are explanatory drawings showing each step of the process of a first embodiment of this invention, and show lateral cross sectional end surfaces of the instep portions of a shoe.
Figure 1D:
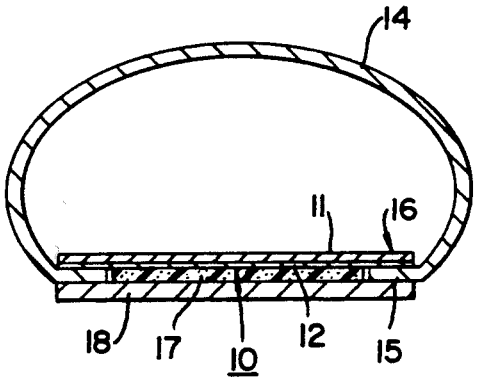

In the drawings, reference numerals 10, 20, 29 denote insole parts; 11, 21, 30 denote insole bases; 12, 22, 31 denote insole sheets; 13, 23 denote lasts; 14, 24 denote uppers; 15, 25 denote end portions; 16 denotes a peripheral end portion; 17, 26 denote fillers; 18, 27 denote outsoles; 19, 28 denote shoes; 32 denotes a front half portion; and 33 denotes a rear half portion.

DETAILED DESCRIPTION OF PREFERRED EMBODIMENTS

Figure 1B:
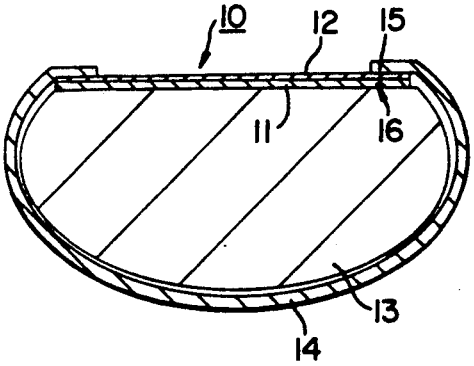
Figure 1E:
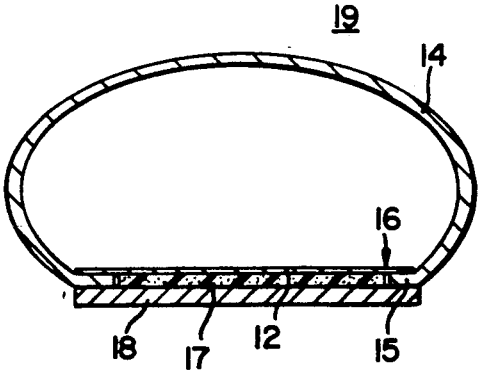
Figure 1C:
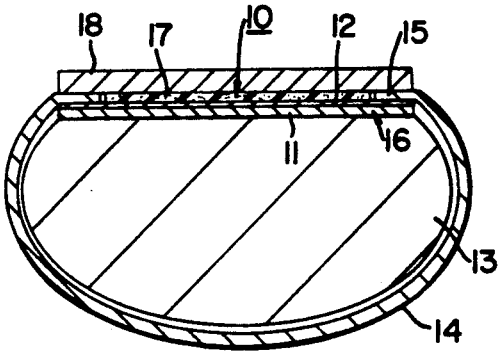
Figure 2:
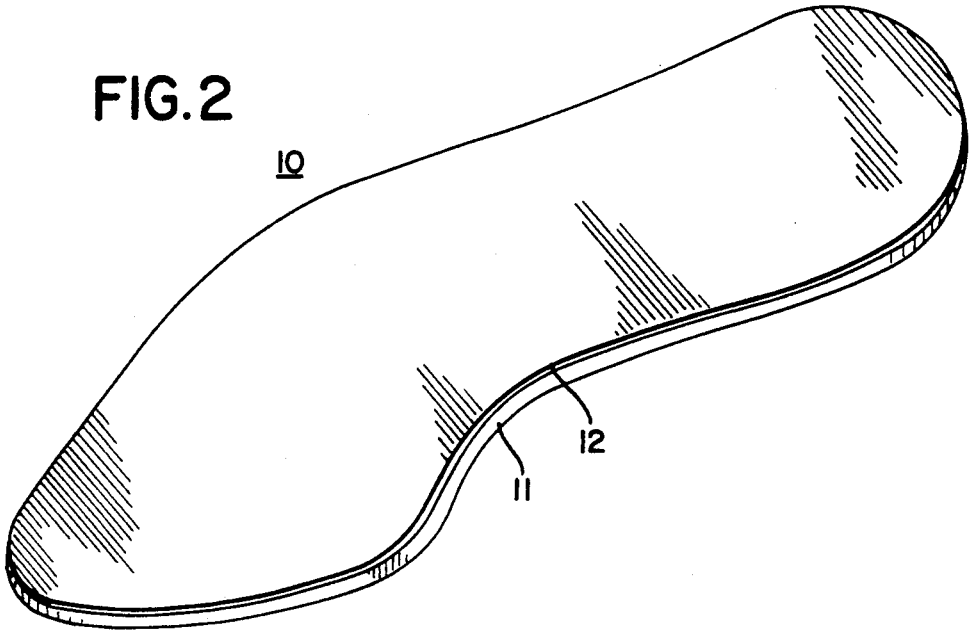
FIG. 2 is a perspective drawing of the insole part used in the embodiment of FIGS. 1A-1E.

FIG. 1 and FIG. 2 show the first embodiment.

An insole part 10 to be used in this embodiment is prepared by cementing an insole base 11 and an insole sheet 12 together. This insole base 11 may be of leather, plywood and the like and is required to have a sufficient thickness which provides a rigidity and strength to withstand a lasting to be described hereinafter, and its thickness is about 1.5-3 mm, and an insole used in the conventional lasting type manufacturing method may be used for the insole base as it is. The insole sheet 12 may be of leather, cloth and the like forming an insole surface of the completed shoes, and is preferably thinner and softer as much as possible in order to form a soft bottom, and its thickness is less than 1 mm, and moreover, it is preferable to form it with its periphery being thinner. A cementing of the insole base 11 and the insole sheet 12 may be carried out by using an adhesive of a weak strength allowing an easy peel apart to be made later on. In the case of using a leather insole sheet, when the grain (a smooth surface of the top side) is directed to the insole base, a rubberlike adhesive material which is called "rubber cement" (rubber material used commonly in shoe manufacturing) may be used.

This insole part 10 is placed on the bottom of the last 13 by arranging the insole sheet to face the outside, and nails are driven to stop them temporarily (FIG. 1A).

And then, the upper 14 is arranged to cover the last 13 to be in contact and the end portion 15 is lasted and is superposed on a peripheral end portion 16 of the insole part 10 and cemented (FIG. 1B). This lasting is normally carried out by a machine, and the cementing is applied after dispersing the creases produced on the end portion 15 uniformly. After the cementing, the nails that temporarily stopped the insole part 10 are removed, and the surface of the end portion 15 formed with the creases is scratched with a file to provide a flat surface and at the same time, it is processed to produce a coarse surface allowing a firm cementing.

Next, the filler 17 is superposed on the insole part 10, and the outsole 18 is superposed on the filler 17 and the end portion 15 of the upper, and they are cemented (FIG. 1C). As the filler 17, normally, foam urethane sheet is used. By the way, this filler 17 may be omitted. As the outsole 18, for the purpose of softening the bottom, a material as soft as possible may be preferable, and soft leather, rubber sheet and the like are used.

Next, the last 13 is pulled out (FIG. 1D), and the insole base 11 is removed by peeling apart from the insole part 10 whereby the shoe 19 is completed (FIG. 1E). In order to remove the insole base 11, a spatula and the like may be inserted into the shoe to lift the insole base 11 whereby the insole base 11 is easily peeled apart and is removed.

By the way, a sock (not shown in the drawing) may be applied to the insole surface of the completed shoes.

Figure 3A:
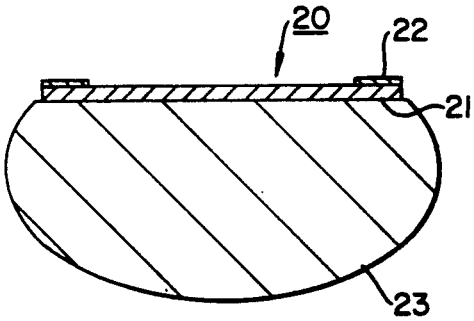
FIGS. 3A and 3B are explanatory drawings showing a second embodiment of the method of this invention, and show lateral cross sectional end surfaces of the instep portion of a shoe.
Figure 3B:
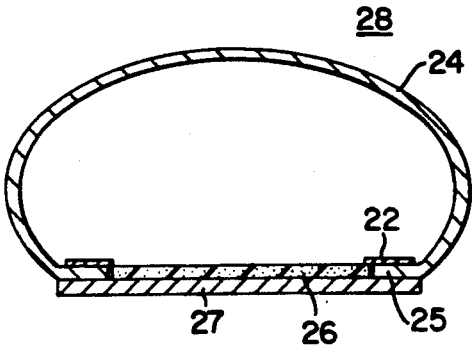
Figure 4:
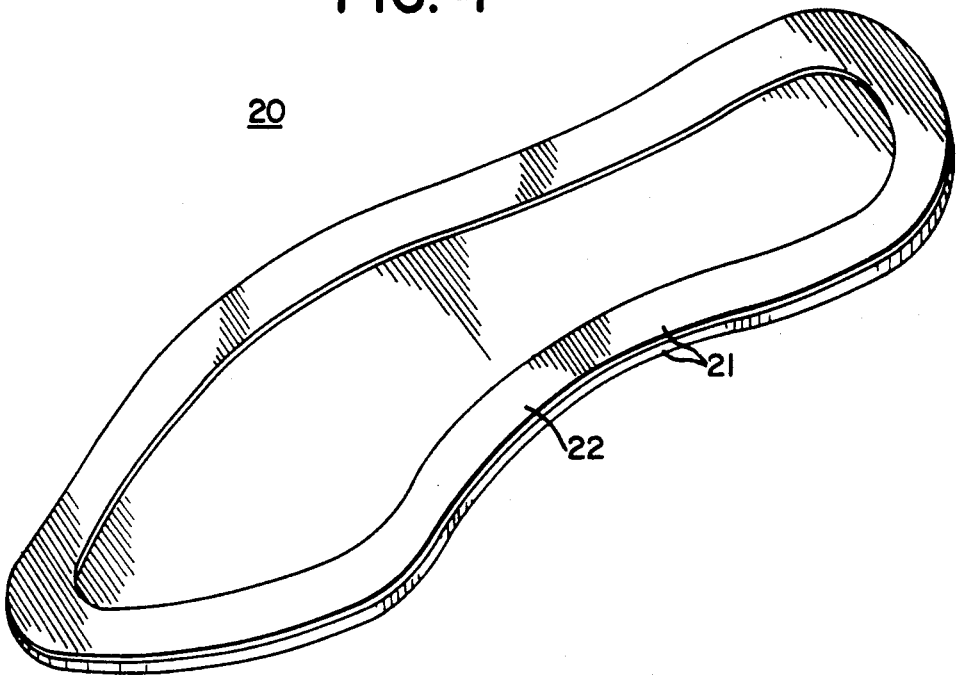
FIG. 4 is a perspective drawing of the insole part to be used in the second embodiment.

FIGS. 3 and 4 show the second embodiment.

The insole part 20 to be used in this embodiment is produced by cementing the insole sheet 22 on the insole base 21. This insole sheet 22 is a sheet of a form consisting of a peripheral portion of the insole part 20 superposed with the end portion of the upper.

With respect to other points, this embodiment is entirely same with the foregoing embodiment, and this insole part 20 is placed on the last 23 (FIG 3A), and the insole sheet 22 is superposed on the end portion 25 of the upper 24, and the filler 26 and the outsole 27 are mounted, and thus the shoe 28 whose filler 26 is directly exposed to the insole surface is completed (FIG. 3B).

Figure 5:
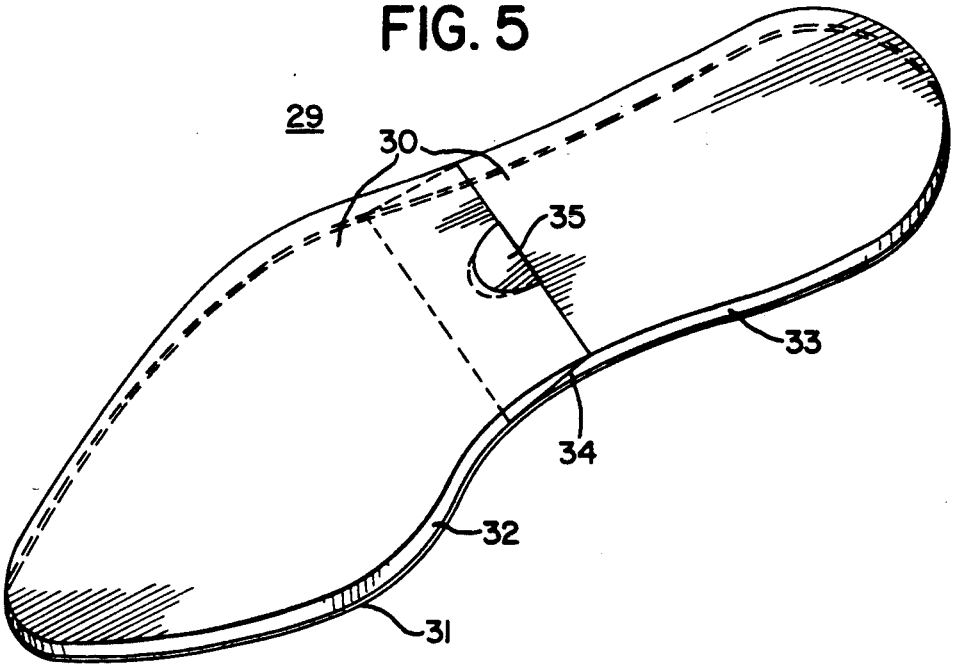
FIG. 5 is a perspective drawing of an insole part of a third embodiment.
Figure 6A:
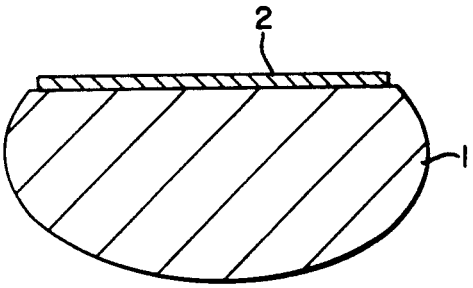
FIG. 6A (PRIOR ART)
FIGS. 6A-6D are explanatory drawings showing a conventional lasting type manufacturing method, and show lateral cross sectional end surfaces of a shoe.
Figure 6C:
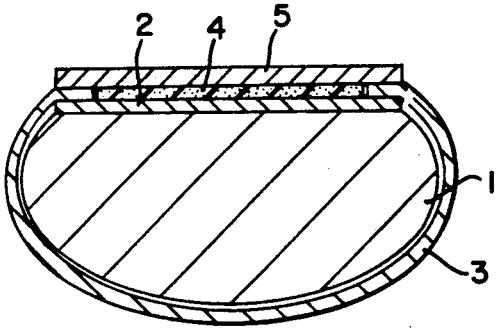
FIG. 6C (PRIOR ART)
Figure 6B:
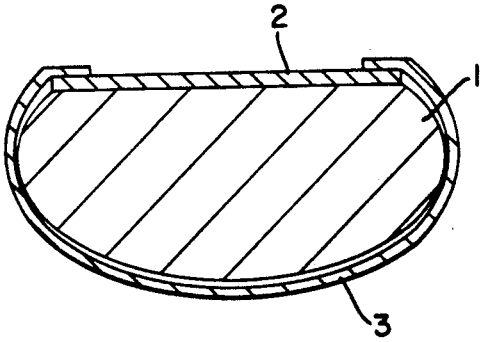
FIG. 6B (PRIOR ART)
Figure 6D:
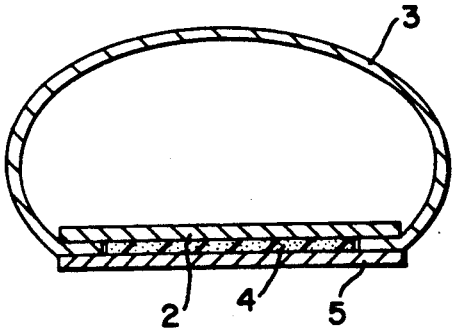
FIG. 6D (PRIOR ART)
Figure 7A:
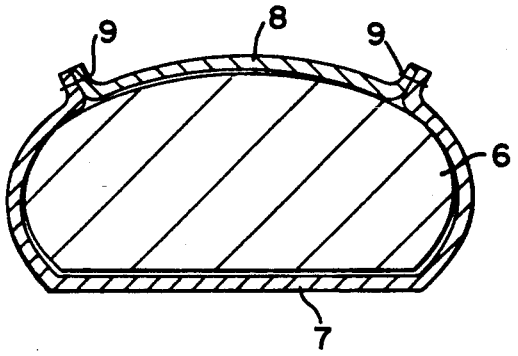
FIG.7A (PRIOR ART)
FIGS. 7A and 7B are explanatory drawings showing a process of the conventional moccasin type manufacturing method and show lateral cross sectional end surfaces of the shoes.
Figure 7B:
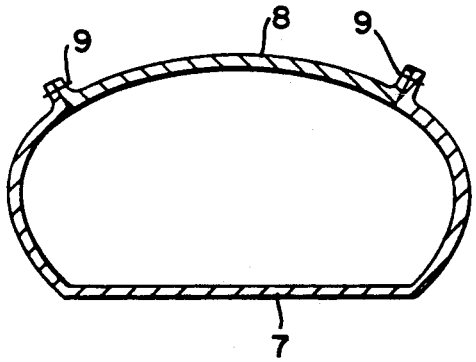
FIG.7B (PRIOR ART)

FIG. 5 shows the third embodiment.

This insole part 29 is formed by cementing the insole sheet 31 on the insole base 30. This insole base 30 is formed in such a way that a front half portion or part 32 and a rear half portion or part 33 are weakly cemented with an aslant surface 34, and only the front half portion or part 32 can be removed by peeling apart. By the way, the aslant surface 34 is formed with a recess portion 35 into which a spatula for peeling apart the front half portion 32 is inserted.

The shoe is manufactured similar to the foregoing by using the insole part 29, and only a part or the front half portion 32 of the insole base 30 is removed in the final process whereby a shoe having a soft front half bottom may be produced.

As described in the foregoing, the manufacturing method of the shoes according to this invention is such that an insole part produced by cementing a hard insole base and a soft insole sheet is used, and the shoe making operation is carried out similar to the conventional lasting type manufacturing method and finally, the insole base is removed by peeling it apart from the soft insole sheet so that the shoes can be manufactured with a high efficiency using a machine which is similar to that used in the lasting type manufacturing method. Since the hard insole base is removed and the soft insole sheet only remains in the shoe, the manufactured shoe has the soft bottom and provides a comfortable feeling without the slipping of the heel during the walking which easily fits the foot because of its flexibility. Of course, this shoe is of a light type, and has features specific to the lasting type that the upper is finished smoothly, and a variety of designs become possible therefore. Also, since the volume of the insole part becomes small, the external shape of the shoe becomes small relative to its internal shape and it gives an impression that the foot appears to be smaller which are desirable qualities for ladies' shoes.

The insole part of this invention is used in the foregoing manufacturing method and particularly, in case the insole sheet is arranged to be formed to cover only the surface superposed with the end portion of the upper, each of the foregoing advantageous points is further enhanced. Furthermore, in case the insole sheet is made of leather, and the grain is cemented by being directed to the insole base, the desirable insole part can be materialized which provides the sufficient cementing strength and the easy peel-apart, and also, prevents the insole sheet surface from spoilage after the peel-apart.

In case the insole base is split and only a part of the insole base is removed by peeling apart, a shoe only a part of whose bottom is soft may be obtained which meets with a variety of purposes.

What is claimed is:

1. An insole part for a shoe consisting of: a soft and thin insole sheet having a surface cemented on an insole base of a different material having a rigidity and strength sufficient to withstand lasting of an upper having end portions superposed upon a peripheral portion of the insole sheet overlying a peripheral portion of the insole base, at least a part of said insole base being removable by peeling apart from said insole sheet after lasting to expose said surface of said insole sheet as an inner surface of the shoe.

2. An insole part consisting of a soft and thin insole sheet cemented on and covering only a peripheral portion of an insole base of a different material having a rigidity and strength sufficient to withstand lasting of an upper having end portions superposed upon said insole sheet covering a peripheral portion of the insole base, said insole base being removable by peeling apart from said insole sheet.

3. An insole part according to claim 2 in which the insole base is split in at least two parts, and only one of said parts of said insole base including a peripheral portion opposed to said peripheral portion of the insole sheet during lasting may be removed by peeling apart from the insole sheet.

4. An insole part according to claim 1 or 2 in which the insole sheet is made of leather, and said insole part is produced by facing a grain of the inside sheet to the insole base, and cementing said grain to the insole base.

5. An insole part according to claim 1 or 2 in which the insole base is split to provide at least t vo parts, and only one of said parts of said insole base including a peripheral portion opposed to said peripheral portion of the insole sheet during lasting may be removed by peeling apart from the insole sheet.

* * * * *